US009925579B2

(12) United States Patent
Yoshimichi et al.

(10) Patent No.: US 9,925,579 B2
(45) Date of Patent: Mar. 27, 2018

(54) PROCESSING TOOL AND HEMMING DEVICE

(71) Applicant: HONDA MOTOR CO., LTD., Tokyo (JP)

(72) Inventors: Hitoshi Yoshimichi, Utsunomiya (JP); Hiroshi Miwa, Utsunomiya (JP); Shigetoshi Namiki, Nasukarasuyama (JP)

(73) Assignee: HONDA MOTOR CO., LTD., Tokyo (JP)

( * ) Notice: Subject to any disclaimer, the term of this patent is extended or adjusted under 35 U.S.C. 154(b) by 164 days.

(21) Appl. No.: 14/895,615

(22) PCT Filed: Feb. 6, 2014

(86) PCT No.: PCT/JP2014/052772
§ 371 (c)(1),
(2) Date: Dec. 3, 2015

(87) PCT Pub. No.: WO2014/199657
PCT Pub. Date: Dec. 18, 2014

(65) Prior Publication Data

US 2016/0121386 A1 May 5, 2016

(30) Foreign Application Priority Data

Jun. 10, 2013 (JP) ..... 2013-121699

(51) Int. Cl.
*B21D 19/04* (2006.01)
*B21D 39/02* (2006.01)

(52) U.S. Cl.
CPC ..... *B21D 39/023* (2013.01); *B21D 19/043* (2013.01)

(58) Field of Classification Search
CPC ..... B21D 19/02; B21D 19/04; B21D 19/043; B21D 39/02; B21D 39/021; B21D 39/023; B25J 9/0015; B25J 9/1085; B25J 15/0019
See application file for complete search history.

(56) References Cited

U.S. PATENT DOCUMENTS 4,828,451 A * 5/1989 Mikoshi ..... B25J 9/046 414/680
5,207,554 A * 5/1993 Asakawa ..... B23P 19/102 33/DIG. 13
5,430,643 A * 7/1995 Seraji ..... B25J 9/1643 318/568.11

(Continued)

FOREIGN PATENT DOCUMENTS

CN 101203337 6/2008
DE 10011854 A1 * 9/2001 ..... B21D 39/02

(Continued)

OTHER PUBLICATIONS

Traslation, DE 10011854A1, Sep. 2001.*
Chinese Office Action with English Translation dated Jul. 25, 2016, 15 pages.

*Primary Examiner* — Edward Tolan
(74) *Attorney, Agent, or Firm* — Rankin, Hill & Clark LLP

(57) ABSTRACT

A hemming device wherein a processing tool is equipped with a base part moved by a robot, a processing unit having a hemming roller and a guide roller, and a floating mechanism that is attached to the base part and elastically supports the processing unit with six degrees of freedom.

8 Claims, 10 Drawing Sheets

(56) References Cited

U.S. PATENT DOCUMENTS

| | | | | |
|---|---|---|---|---|
| 7,290,423 | B2 * | 11/2007 | Carsley | B21D 39/02 72/128 |
| 7,779,524 | B2 * | 8/2010 | Campian | B21D 39/02 29/243.5 |
| 7,950,260 | B2 * | 5/2011 | Kinouchi | B21D 19/04 29/243.58 |
| 9,352,376 | B2 * | 5/2016 | Cyrek | B21D 39/023 |
| 9,527,215 | B2 * | 12/2016 | Kraus | B21D 39/021 |
| 2008/0250835 | A1 * | 10/2008 | Hasegawa | B21D 39/021 72/220 |

FOREIGN PATENT DOCUMENTS

| | | | | |
|---|---|---|---|---|
| JP | 2010-253614 | | 11/2010 | |
| JP | 2010-279980 | | 12/2010 | |
| KR | 1020100028349 | A * | 3/2010 | B21D 19/04 |

* cited by examiner

PROCESSING TOOL AND HEMMING DEVICE

TECHNICAL FIELD

The present invention relates to a processing tool and a hemming process device (hemming device) for performing a hemming process on an edge portion of a workpiece.

BACKGROUND ART

For example, with respect to edges of a bonnet, a trunk, a door, and a wheel housing of an automobile, a hemming process is carried out by which a flange that is erected on the edge of a panel is folded and bent inwardly of the panel. As such a hemming process, a roll hemming process can be offered, in which the panel is positioned and retained on a fixing mold, and then a flange of an end part on the panel is bent while a roller is pressed with respect to the flange. With such a roll hemming process (hereinafter referred to simply as a hemming process), taking into consideration the bending accuracy for bending a large angle, a process is performed that involves a plurality of steps including a preparatory bending (pre-hemming) step and a finishing bending (main hemming) step.

In this type of hemming process, a workpiece is set on a mold that is disposed in a dedicated space for performing a specified process, and a hemming roller, which is disposed on a working tool that is held on the distal end of a robot, is rolled along the flange. Accordingly, in this manner, the hemming process is carried out (see, for example, Japanese Laid-Open Patent Publication No. 2010-279980).

As disclosed in Japanese Laid-Open Patent Publication No. 2010-279980, a hemming roller and a guide roller are capable of being displaced in a first direction, and in a second direction that is perpendicular to the first direction. According to this structure, even if errors in the movement trajectory of the robot (deviations with respect to the regular movement trajectory during operation) occur, such errors can be absorbed by displacement actions in the first direction and the second direction. Consequently, the influence of errors in the movement trajectory being imparted to the hemming process can be suppressed, and the burden on the robot or the processing tool can be reduced.

SUMMARY OF INVENTION

Incidentally, in the case that a multi-joint articulated robot is used as a movement mechanism for moving the processing tool used for the hemming process, errors in the movement trajectory of the robot occur due to changes in a backlash amount of gear sections caused by variations in temperature, for example. Therefore, errors in the operating axes that constitute rotating joints result in errors applied to angles of rotation. Consequently, in the case of a robot realized by rotating joints at multiple degrees of freedom (for example, a robot in which six degrees of freedom are realized by six rotating joints), the errors in the movement trajectory of the robot, rather than being linear errors, are primarily errors that accompany rotation.

On the other hand, with a configuration adapted to absorb errors in the movement trajectory of robot operations only by linear actions, errors in directions that are not related to linear movements, or errors accompanying rotation, cannot be absorbed.

The present invention has been devised taking into consideration such problems, and has the object of providing a processing tool and a hemming process device, in which errors that occur accompanying rotation of robot operations when the hemming process is performed can be absorbed.

In order to achieve the aforementioned objects, the present invention is characterized by a processing tool, which is used by a hemming process device configured to perform a hemming process with respect to an edge portion of a workpiece using a hemming roller and a guide member, including a base part configured to be moved by a moving mechanism, a processing unit having the hemming roller and the guide member, and a floating mechanism attached to the base part and configured to elastically support the processing unit with six axial degrees of freedom.

According to the above configuration, because the processing unit having the hemming roller and the guide member is supported by the floating mechanism having six axial degrees of freedom, deviations (rotation errors) in the movement trajectory accompanying rotation of operations of the moving mechanism can be absorbed. Consequently, even if the moving mechanism is operated at high speed, rotation errors accompanying high speed operations are not transmitted to the hemming roller. Thus, along with an enhancement in processing speed, it is possible to improve process quality. Further, the load applied to the processing tool or the moving mechanism caused by such rotation errors can be reduced.

In the aforementioned processing tool, the floating mechanism may include a support member configured to support the processing unit, and an elastic member disposed between the base part and the support member. According to this configuration, the floating mechanism having six axial degrees of freedom can be realized with a simple structure.

In the above-described processing tool, the base part may include a first member and a second member, which are disposed across from each other. In addition, plural elastic members may be provided, and the elastic members may be disposed, respectively, between the first member and the support member, and between the second member and the support member. According to such a configuration, a floating mechanism can be realized, which is capable of more effectively absorbing rotation errors of operations of the moving mechanism.

In the above-described processing tool, the first member and the second member may be mutually connected by connecting members that penetrate through the elastic members. According to this structure, the connecting members function in a dual manner to connect the first member and the second member, in addition to supporting the elastic member, and therefore, the number of parts can be reduced.

In the aforementioned processing tool, a lock mechanism may further be provided that is configured to releasably restrict displacement of the processing unit with respect to the base part. According to this structure, even in the event that the moving mechanism is operated at high speed, by means of the locked state of the lock mechanism, vibrations of the processing unit with respect to the base part are suppressed. Therefore, during an operation when the processing tool grips a mold for setting of the workpiece thereon, collisions of the processing tool against the mold can be prevented.

In the above-described processing tool, the floating mechanism may include a support member configured to support the processing unit, and an elastic member disposed between the base part and the support member, and the lock mechanism may include a lock member configured to operate between an unlocking position where the lock member is separated from the support member, and a locking position where the lock member contacts with and locks the support member. In addition, the support member may be positioned in a predetermined position by displacement of the lock member to the locking position. According to this configuration, the support member is positioned in the predetermined position when the lock mechanism is in a locked state. Therefore, during an operation when the processing tool grips a mold for setting of the workpiece thereon, engagement of the guide member with respect to a guide groove that is provided on the mold can be carried out without any trouble.

In the aforementioned processing tool, plural lock members may be provided, and each of the plural lock members may include a first lock member configured to press the support member in a first pressing direction, and a second lock member configured to press the support member in a second pressing direction, which is opposite to the first pressing direction, at a location that differs from a location where the first lock member presses the support member. According to such a configuration, the support member can be suitably positioned by a small number of lock members, and the structure of the lock mechanism can be simplified.

In the aforementioned processing tool, the lock mechanism may include a first drive unit configured to press on and displace the first lock member to the locking position, and a second drive unit configured to pull on and displace the second lock member to the locking position. In addition, the first drive unit and the second drive unit may be disposed on a same side with respect to the support member. According to such a configuration, since the first drive unit and the second drive unit are disposed on the same side with respect to the support member, the structure of the lock mechanism can be simplified.

Further, a hemming process device according to the present invention, which carries out a hemming process with respect to an edge portion of a workpiece using a hemming roller and a guide member, includes a processing tool, and a robot configured to act as a moving mechanism configured to move the processing tool. In the hemming process device, the processing tool includes a base part configured to be moved by the moving mechanism, a processing unit having the hemming roller and the guide member, and a floating mechanism attached to the base part and configured to elastically support the processing unit with six axial degrees of freedom.

According to the processing tool and the hemming process device of the present invention, errors that occur accompanying rotation of robot operations when the hemming process is performed can be absorbed.

DESCRIPTION OF EMBODIMENTS

Hereinafter, preferred embodiments of a processing tool and a hemming process device according to the present invention will be described in detail below with reference to the accompanying drawings.

Figure 1:
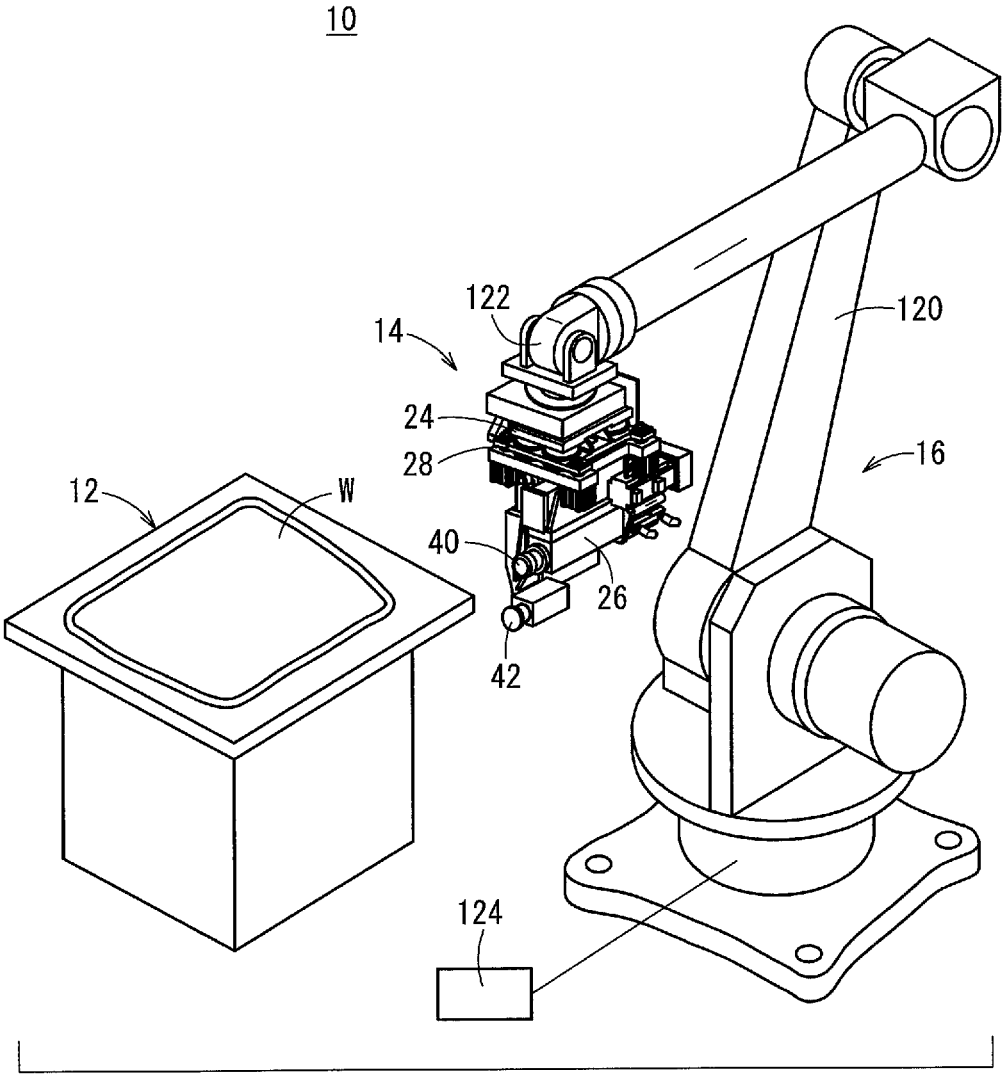
FIG. 1 is a perspective view of a hemming process device according to an embodiment of the present invention.

FIG. 1 is a perspective view of a hemming process device 10 according to an embodiment of the present invention. The hemming process device 10 is an apparatus for carrying out a hemming process for bending an edge portion 22 (see FIG. 7A) of a workpiece W. The workpiece W, for example, is a bonnet, a trunk lid, a door, or the like, and the locations on which the hemming process is performed is an edge portion 22 of such workpieces. Alternatively, the workpiece W may be a wheel housing, and the location on which the hemming process is performed may be an edge portion 22 of the wheel housing.

In the present embodiment, the hemming process device 10 is equipped with a fixing mold 12 for placing and fixing the workpiece W thereon, a processing tool 14 that comes into contact with and performs a hemming process on the workpiece W, and a robot 16 to which the processing tool 14 is attached to a distal end thereof, and which serves as a moving mechanism for moving the processing tool 14.

A mounting section 18 on which the workpiece W is set (see FIG. 7A) is disposed on an upper surface of the fixing mold 12. In a state with the workpiece W placed on the mounting section 18, the workpiece W is fixed to the fixing mold 12 by a non-illustrated fixing means (for example, a clamping device). A guide groove 20 (see FIG. 7A), which receives a later-described guide roller 42 and serves to guide the guide roller 42, is disposed on a lower surface of the fixing mold 12. The guide groove 20 extends in a direction of extension of the edge portion 22 of the workpiece W that is mounted on the fixing mold 12.

Figure 2:
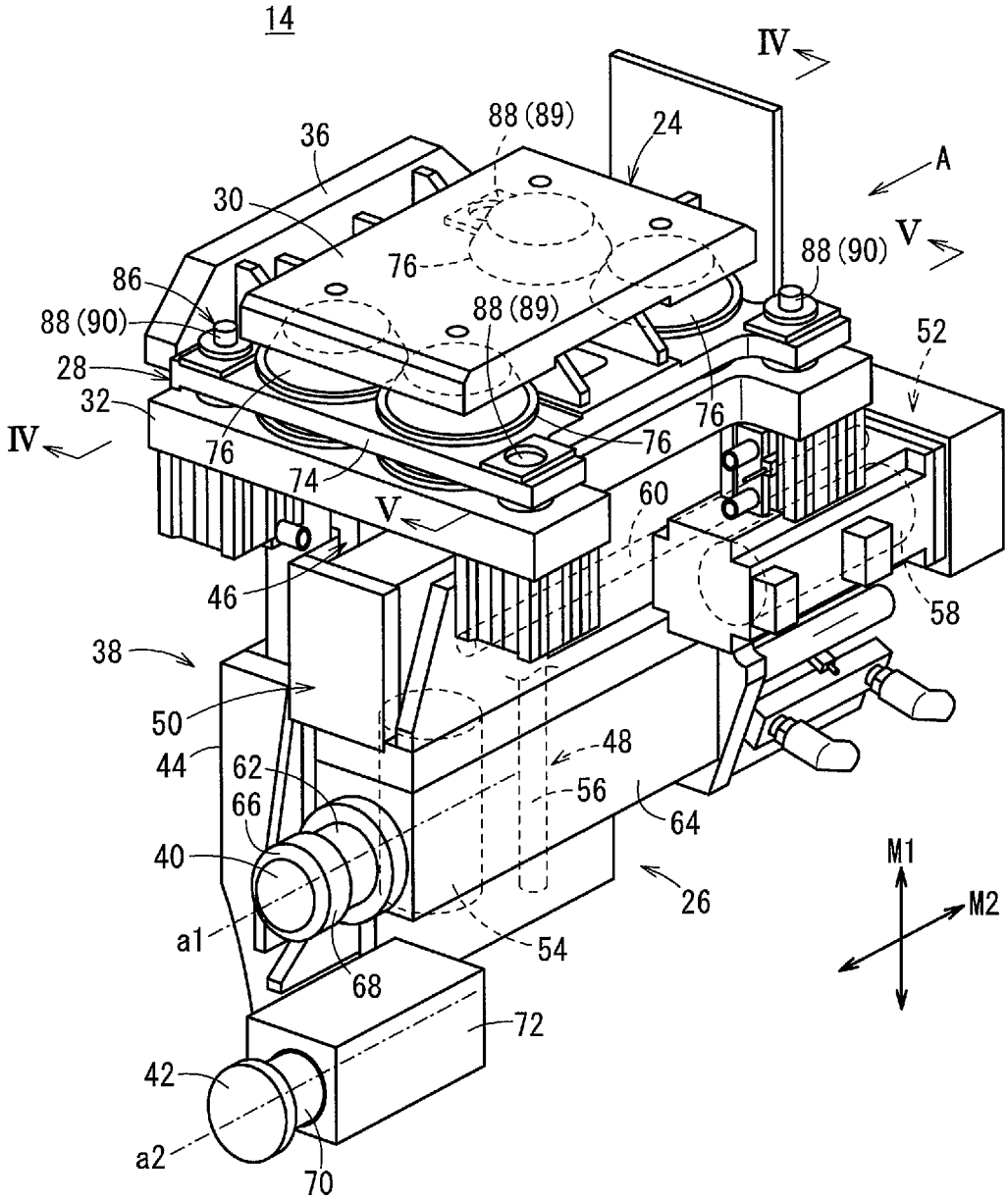
FIG. 2 is a perspective view of a processing tool in the hemming process device shown in FIG. 1.

Next, the processing tool 14 will be described. FIG. 2 is a perspective view of the processing tool 14. The processing tool 14 is equipped with a base part 24 that is attached and fixed to an arm distal end (hand unit 122) of the robot 16, a processing unit 26 having a hemming roller 40 and the guide roller 42 (guide member), and a floating mechanism 28 that elastically supports the processing unit 26.

The base part 24 includes a first member 30 and a second member 32, which are disposed across from each other. Both the first member 30 and the second member 32 of the illustrated example are formed in plate-like shapes. The first member 30 is fixed to the hand unit 122 (see FIG. 1) of the robot 16. The second member 32 is arranged in parallel with respect to the first member 30 at a given interval through plural bolts 34 (see FIG. 4) that serve as connecting members.

The floating mechanism 28 is attached to the above-described base part 24, and the processing unit 26 is attached to the floating mechanism 28. More specifically, the processing unit 26 is supported by the base part 24 through the floating mechanism 28.

The processing unit 26 includes an actuator unit 38 that is fixed to the floating mechanism 28 (specifically, a later-described floating plate 74) through a bracket 36, and also includes a hemming roller 40 and a guide roller 42, which are supported rotatably on the actuator unit 38.

Figure 3:
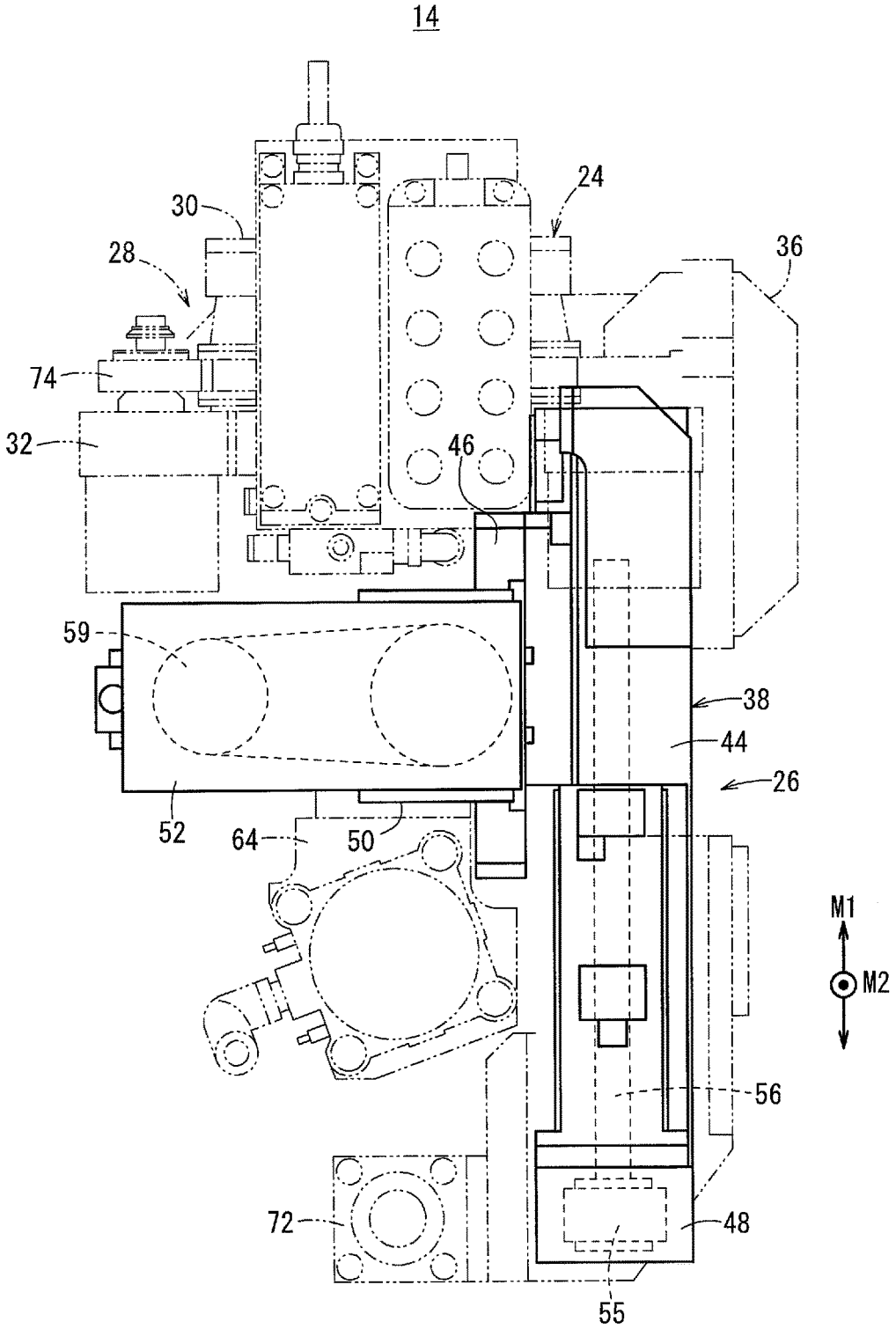
FIG. 3 is a rear view of the processing tool as seen from the direction of the arrow A in FIG. 2.

FIG. 3 is a rear view of the processing tool 14 as seen from the direction of the arrow A in FIG. 2. In FIG. 3, the actuator unit 38 is shown by the solid lines, whereas other parts are shown by dashed lines or two-dot dashed lines. As shown in FIGS. 2 and 3, the actuator unit 38 includes a unit base 44, which is fixed to the bracket 36 and extends in a first direction M1, a first moving unit 46 that is capable of moving in the first direction M1 with respect to the unit base 44, a first drive mechanism 48 that operates the first moving unit 46 in the first direction M1, a second moving unit 50 that is capable of moving with respect to the first moving unit 46 in a second direction M2 perpendicular to the first direction M1, and a second drive mechanism 52 that operates the second moving unit 50 in the second direction M2. The hemming roller 40 is attached to the second moving unit 50.

As shown in the illustrated example, the first drive mechanism 48 includes a motor 54, and a ball screw 56 that is driven by the motor 54. A rotational driving force of the motor 54 is transmitted to the ball screw 56 through a driving force transmission mechanism 55 (a belt mechanism in the illustrated example). Accompanying rotation of the ball screw 56, the first moving unit 46 is moved in the first direction M1. The first drive mechanism 48 may be a rack and pinion mechanism, a linear motor or the like, or other forms of linear actuators.

In the illustrated example, the second drive mechanism 52 includes a motor 58, and a ball screw 60 that is driven by the motor 58. A rotational driving force of the motor 58 is transmitted to the ball screw 60 through a driving force transmission mechanism 59 (a belt mechanism in the illustrated example). Accompanying rotation of the ball screw 60, the second moving unit 50 is moved in the second direction M2. The second drive mechanism 52 may be a rack and pinion mechanism, a linear motor or the like, or other forms of linear actuators.

The hemming roller 40 is a working roller that contacts the edge portion 22 of the workpiece W and presses and bends the edge portion 22. In the illustrated example, the hemming roller 40 is attached to the second moving unit 50. A shaft 62 of the hemming roller 40 is supported rotatably by a non-illustrated bearing, which is accommodated in a bearing box 64 that is fixed to the second moving unit 50. The second direction M2, which is the direction of movement of the aforementioned second moving unit 50, coincides with the direction of the axis of rotation a1 of the hemming roller 40. The hemming roller 40 is capable of moving in the first direction M1 together with movement of the first moving unit 46 in the first direction M1. Further, the hemming roller 40 is capable of moving in the second direction M2 together with movement of the second moving unit 50 in the second direction M2.

The hemming roller 40 of the illustrated embodiment includes a tapered part 66 having a tapered shape (frusto-conical shape) on the distal end side thereof, and a cylindrical part 68 provided more toward the proximal end side than the tapered part 66. The tapered part 66 is a portion that is inclined with respect to the axis of rotation a1, such that the outer diameter thereof becomes reduced in the distal end direction of the hemming roller 40. The angle of inclination of the tapered part 66 with respect to the axis of rotation a1 may be changed midway therealong. The cylindrical part 68 is a portion that lies parallel with the axis of rotation a1.

On the other hand, the guide roller 42 is capable of engagement with the guide groove 20 that is disposed on the fixing mold 12, and in the illustrated example, the guide roller 42 is attached to the unit base 44. A shaft 70 of the guide roller 42 is supported rotatably by a non-illustrated bearing, which is accommodated in a bearing box 72 that is fixed to the unit base 44. The axis of rotation a2 of the guide roller 42 is parallel with the axis of rotation a1 of the hemming roller 40. Consequently, the second direction M2, which is the direction of movement of the aforementioned second moving unit 50, coincides with the direction of the axis of rotation a2 of the guide roller 42.

The hemming roller 40 and the guide roller 42 are separated from each other in the first direction M1. Accompanying movement of the hemming roller 40 in the first direction M1 by operation of the first drive mechanism 48, the hemming roller 40 moves in directions to approach toward and separate away from the guide roller 42.

Figure 4:
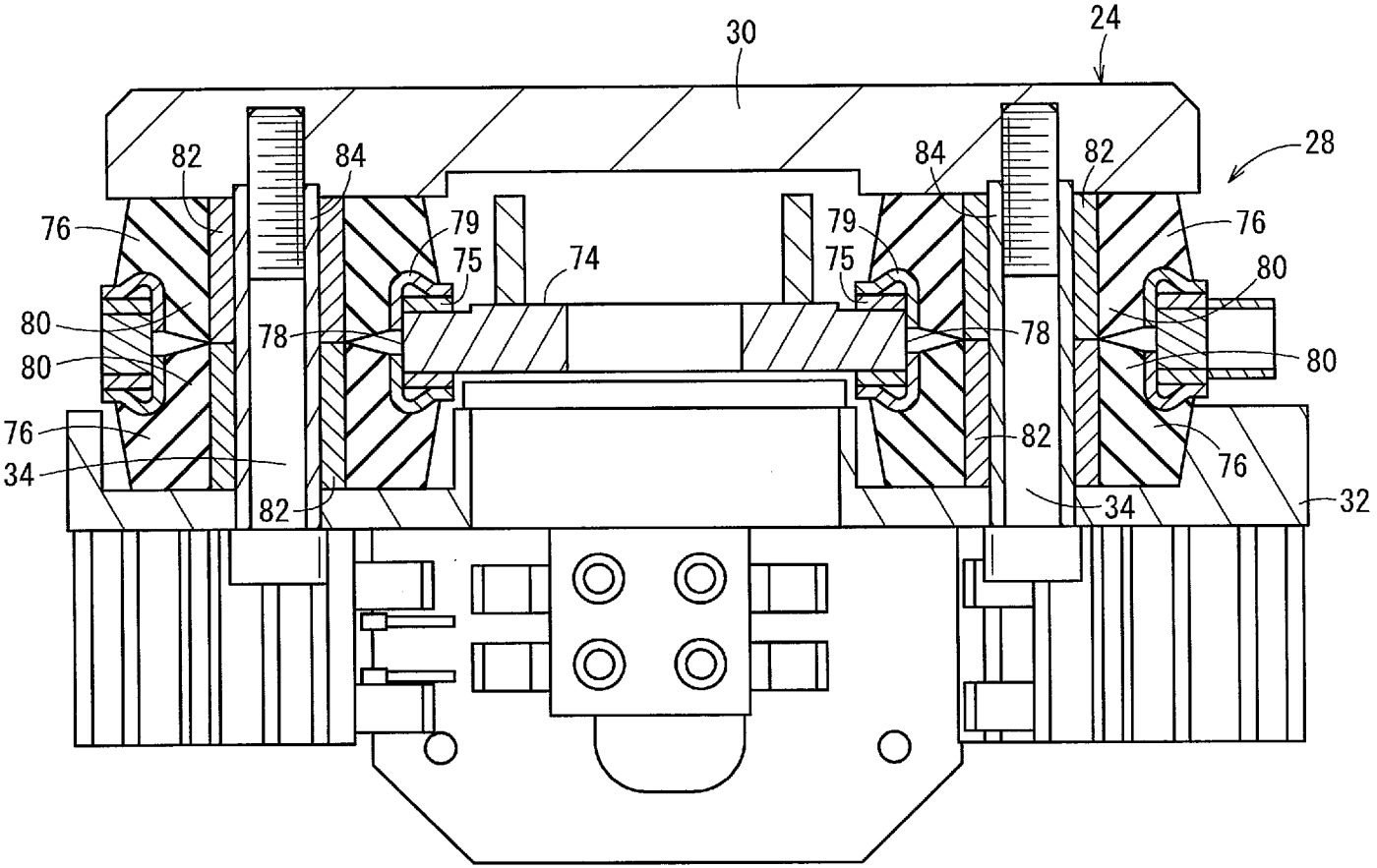
FIG. 4 is a cross-sectional view taken along line IV-IV of FIG. 2.

Next, the structure of the floating mechanism 28 will be described. The floating mechanism 28 is fixed with respect to the base part 24, and elastically supports the processing unit 26 with six axial degrees of freedom. FIG. 4 is a cross-sectional view taken along line IV-IV of FIG. 2. As shown in FIGS. 2 and 4, according to the present embodiment, the floating mechanism 28 includes a floating plate 74 (support member) that supports the processing unit 26, and a plurality of elastic members 76 (for example, made from a rubber material), which are disposed between the base part 24 and the floating plate 74.

The floating plate 74 is arranged between the first member 30 and the second member 32 that constitute the base part 24. The floating plate 74 is supported by the elastic members 76 in a state of being separated from the first member 30 and the second member 32. In a state of being sandwiched between the first member 30 and the second member 32 that constitute the base part 24, the elastic members 76 are arranged between the first member 30 and the second member 32. In the present embodiment, four arrangement sections 78 (in the illustrated example, circular through holes) are disposed in the floating plate 74 in the form of a 2-row×2-column matrix. The elastic members 76 are disposed respectively in the arrangement sections 78.

The elastic members 76 of the illustrated embodiment are ring-shaped, and two of such elastic members 76 are arranged coaxially in each of the arrangement sections 78. Consequently, according to the present embodiment, a total of eight elastic members 76 are provided. However, the number of elastic members 76 is not limited to eight, and the number thereof may be seven or less or nine or more. Further, the elastic members 76 are not limited to a structure of being arranged with respect to the floating plate 74 in the form of a 2-row×2-column matrix, and for example, may be arranged in the form of a 3-row×2-column or a 3-row×3-column matrix. Alternatively, the elastic members 76 may be disposed in the floating plate 74 at the respective vertices of a virtual triangle.

The elastic members 76 are circular ring-shaped members having respective protrusions 80 on one end side thereof.

The elastic members 76 are mounted through ring-shaped washers 75 and spacers 79 in the arrangement sections 78 provided in the floating plate 74. Tubular sleeve members 82 are arranged in the elastic members 76. In each of the elastic members 76, a tubular inner sleeve 84 is further arranged on inner sides of two of the sleeve members 82 that are arrayed in the axial direction. Further, in the elastic members 76, bolts 34 are inserted through the inner sleeves 84, and the first member 30 and the second member 32 are connected mutually by the bolts 34.

As shown in FIG. 2, in the present embodiment, the processing tool 14 further comprises a lock mechanism 86 that releasably restricts displacement of the processing unit 26 with respect to the base part 24. The lock mechanism 86 includes lock members 88 that operate between an unlocking position where the lock members 88 are separated from the floating plate 74, and a locking position where the lock members 88 contact with and lock the floating plate 74. Accompanying displacement of the lock members 88 to the locking position, the lock mechanism 86 positions the floating plate 74 in a predetermined position.

According to the present embodiment, a plurality of (in the illustrated example, four) lock members 88 are disposed, so as to exert a fixing action with respect to different multiple locations of the floating plate 74. More specifically, the lock members 88 are disposed at the four corners of a substantially rectangular floating plate 74. Consequently, on the floating plate 74, the positions where the lock members 88 are arranged are located more outwardly than the positions where the multiple elastic members 76 are arranged.

Figure 5:
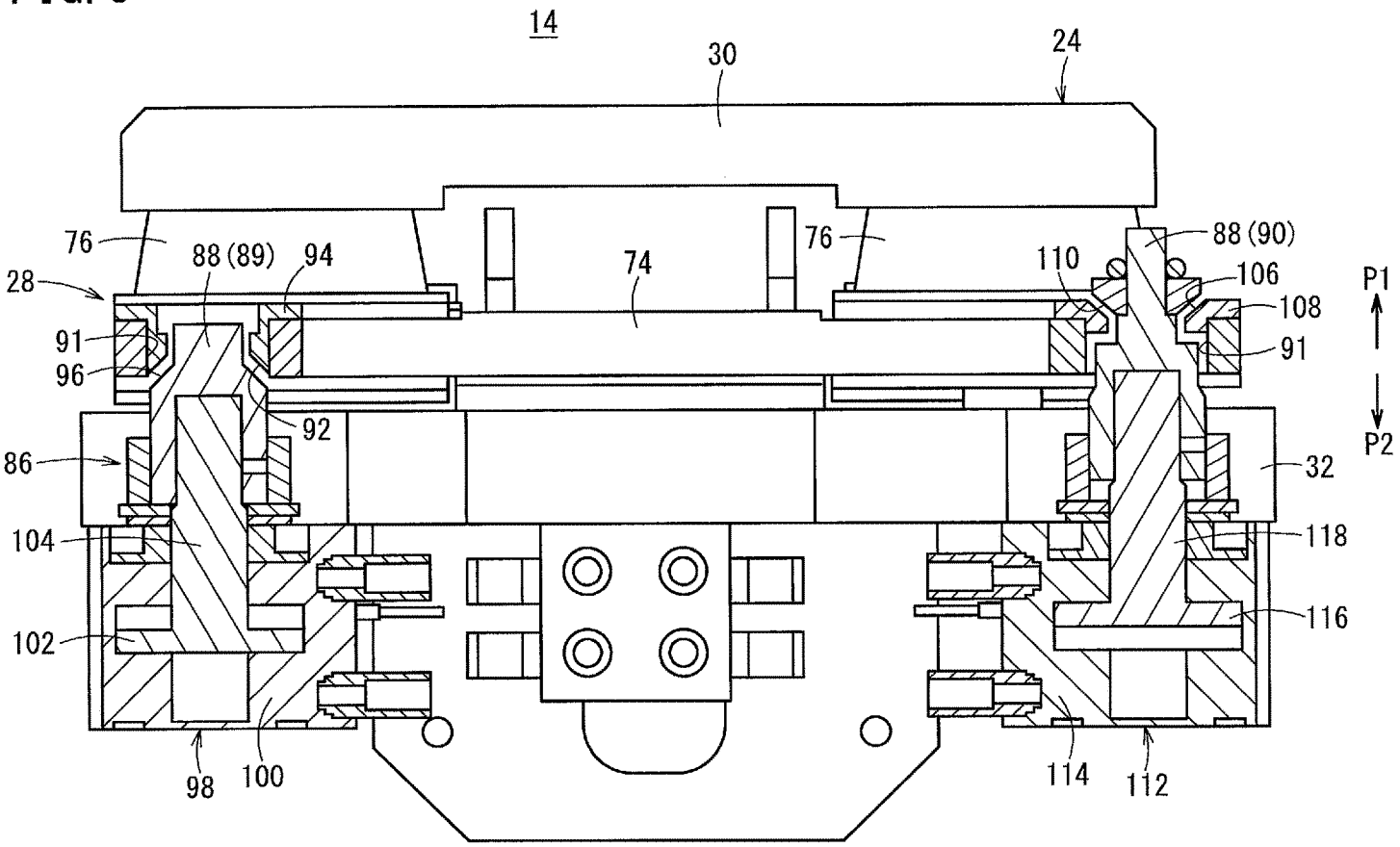
FIG. 5 is a cross-sectional view taken along line V-V of FIG. 2, showing a lock mechanism in an unlocked state.

As shown in FIG. 5, plural lock members 88 are provided, including first lock members 89 that press the floating plate 74 in a first pressing direction P1, and second lock members 90 that press the floating plate 74 in a second pressing direction P2, which is opposite to the first pressing direction P1, at locations that differ from the locations that the first lock members 89 press. According to the present embodiment, two first lock members 89 press on diagonally opposite positions of the floating plate 74, and two second lock members 90 press on other diagonally opposite positions of the floating plate 74. Four through holes 91 are disposed in the floating plate 74 corresponding to the four lock members 88.

Ring-shaped first abutting members 94 having tapered inner circumferential portions 92, the inner diameters of which become greater toward the second member 32, are provided in the through holes 91 corresponding to the first lock members 89. The first lock members 89 are capable of abutting against the first abutting members 94. More specifically, tapered outer circumferential portions 96, the outer diameters of which become greater toward the second member 32, are provided on the first lock members 89. The tapered outer circumferential portions 96 of the first lock members 89 are capable of abutting against the tapered inner circumferential portions 92 of the first abutting members 94.

The lock mechanism 86 includes first drive units 98 that press on and displace the first lock members 89 to the locking position. One first drive unit 98 is provided for each of the first lock members 89. According to the present embodiment, since two first lock members 89 are provided, two first drive units 98 also are provided. A configuration may also be provided in which the two first lock members 89 are operated by a single first drive unit 98.

Further, in the present embodiment, the first drive units 98 take the form of a cylinder device. More specifically, each of the first drive units 98 includes a cylinder main body 100, a piston 102 that is slidable in an axial direction in the interior of the cylinder main body 100, and a rod 104 that extends out from the piston 102. The first lock members 89 are fixed to distal end parts of the rods 104. The first drive units 98 are not limited to a cylinder device, and may take another form such as, for example, a linear motor, or a combined structure of a rotary motor and a rack and pinion, etc.

Figure 6:
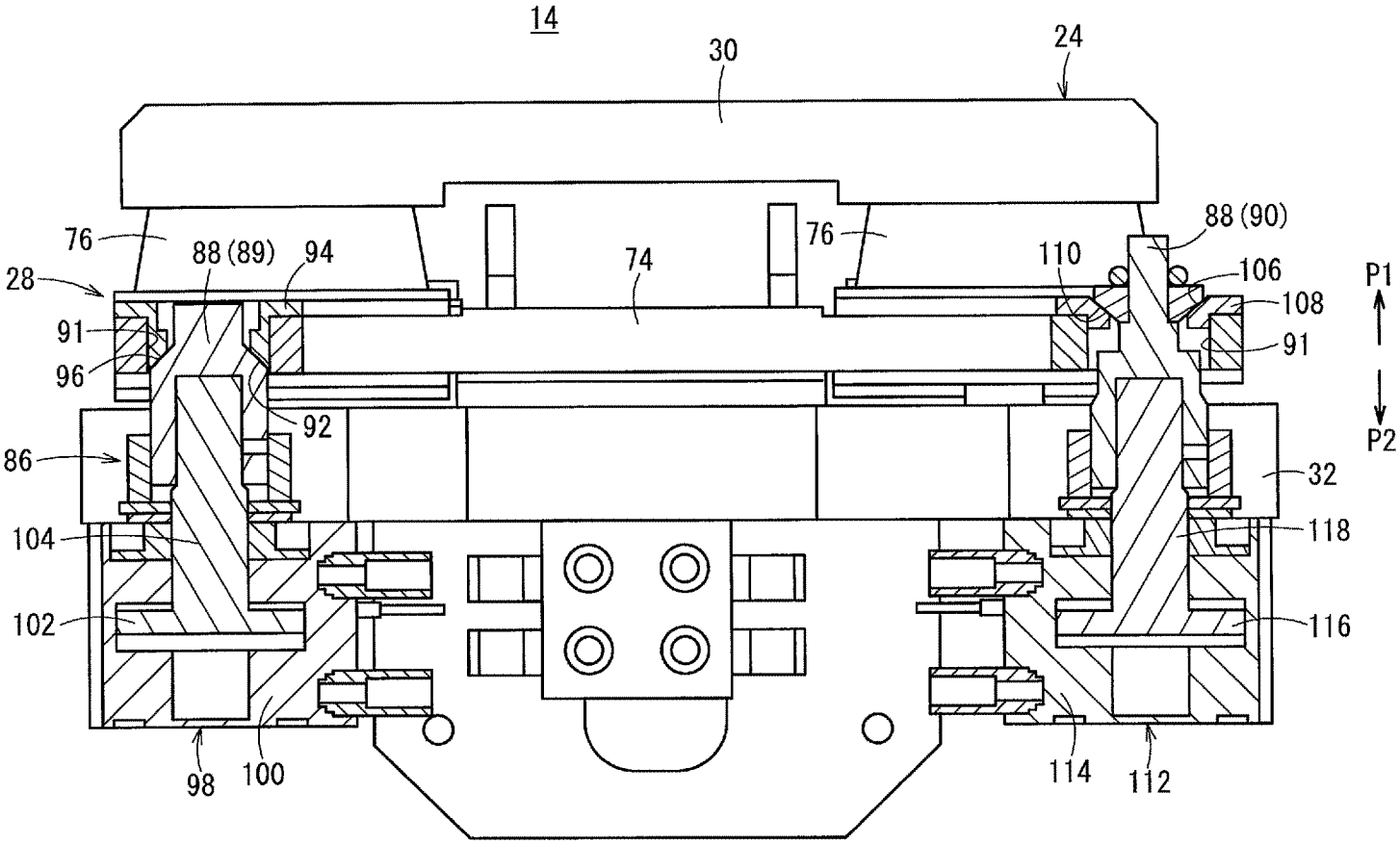
FIG. 6 is a view showing the lock mechanism in a locked state.

As shown in FIG. 5, in a state in which the rods 104 of the first drive units 98 are retracted, since the first lock members 89 and the first abutting members 94 are separated, the floating plate 74 is not fixed by the first lock members 89. On the other hand, as shown in FIG. 6, in a state in which the rods 104 of the first drive units 98 are advanced, since the rods 104 press the first lock members 89 in the first pressing direction P1, the first lock members 89 and the first abutting members 94 come into contact. As a result, the floating plate 74 is pressed in the first pressing direction P1 by the first lock members 89.

Ring-shaped second abutting members 108 having tapered inner circumferential portions 106, the inner diameters of which become greater toward the first member 30, are provided in the through holes 91 corresponding to the second lock members 90. The second lock members 90 are capable of abutting against the second abutting members 108. More specifically, tapered outer circumferential portions 110, the outer diameters of which become greater toward the first member 30, are provided on the second lock members 90. The tapered outer circumferential portions 110 of the second lock members 90 are capable of abutting against the tapered inner circumferential portions 106 of the second abutting members 108.

The lock mechanism 86 includes second drive units 112 that pull on and displace the second lock members 90 to the locking position. One second drive unit 112 is provided for each of the second lock members 90. According to the present embodiment, since two second lock members 90 are provided, two second drive units 112 also are provided. A configuration may also be provided in which the two second lock members 90 are operated by a single second drive unit 112. The first drive units 98 and the second drive units 112 are disposed on the same side (in the illustrated example, on the side of the second member 32) with respect to the floating plate 74.

In the present embodiment, the second drive units 112 take the form of a cylinder device. More specifically, each of the second drive units 112 includes a cylinder main body 114, a piston 116 that is slidable in an axial direction in the interior of the cylinder main body 114, and a rod 118 that extends out from the piston 116. The second lock members 90 are fixed to distal end parts of the rods 118. The second drive units 112 are not limited to a cylinder device, and may take another form such as, for example, a linear motor, or a combined structure of a rotary motor and a rack and pinion, etc.

As shown in FIG. 5, in a state in which the rods 118 of the second drive units 112 are advanced, since the second lock members 90 and the second abutting members 108 are separated, the floating plate 74 is not fixed by the second lock members 90. On the other hand, as shown in FIG. 6, in a state in which the rods 118 of the second drive units 112 are retracted, since the rods 118 pull the second lock members 90 in the second pressing direction P2, the second lock members 90 and the second abutting members 108 come into contact. As a result, the floating plate 74 is pressed in the second pressing direction P2 by the second lock members 90.

With the lock mechanism 86 configured in the foregoing manner, the first lock members 89 press the floating plate 74 in the first pressing direction P1, and the second lock members 90 press the floating plate 74 in the second pressing direction P2, which is opposite to the first pressing direction P1. Owing thereto, the floating plate 74 is positioned (centered) in a predetermined position (neutral position).

Next, returning to FIG. 1, the robot 16 will be described. The robot 16 is a multi-joint articulated industrial robot, in which the processing tool 14, which is attached to the hand unit 122 constituting the distal end of an articulated arm 120, is capable of being moved to an arbitrary position within an allowable range of movement, and of changing the posture thereof in an arbitrary manner. According to the present embodiment, the robot 16 includes six rotational joints, and thereby possesses six axial degrees of freedom. The robot 16 is controlled by a controller 124. The controller 124 includes operation information therein for operating the robot 16 along a predetermined movement trajectory. The operation information is information that is stored beforehand by way of teaching or by an operation program.

The processing tool 14 and the hemming process device 10 according to the present invention are constructed basically as described above. Next, operations and advantages of the processing tool 14 and the hemming process device 10 will be described.

Figure 7A:
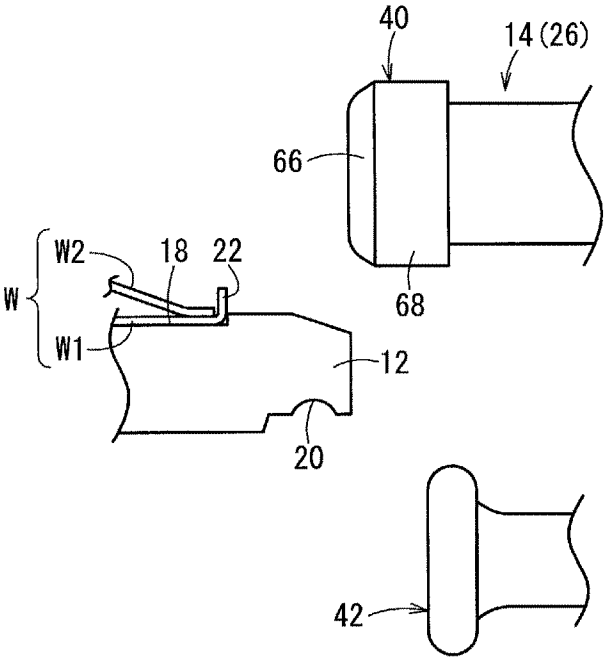
FIG. 7A is a descriptive view showing a condition in which a workpiece is set on a fixing mold.

For implementing a hemming process with respect to the edge portion 22 of the workpiece W by the hemming process device 10 equipped with the processing tool 14, initially, as shown in FIG. 7A, the workpiece W is placed on the mounting section 18 of the fixing mold 12. The workpiece W includes a first workpiece W1, which is flanged by bending the edge portion 22 thereof substantially perpendicularly, and a second workpiece W2, which is mounted in an overlapping manner on the first workpiece W1.

Figure 7B:
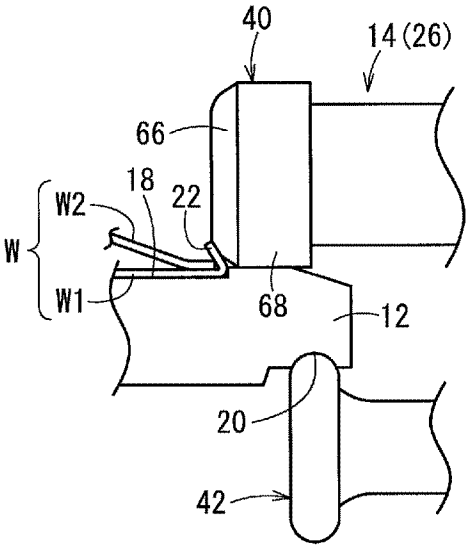
FIG. 7B is a descriptive view of a first hemming process.

Then, in a state (the condition shown in FIG. 6) in which floating of the processing tool 14 is locked by the lock mechanism 86, the processing tool 14 is brought in proximity to the workpiece W, and as shown in FIG. 7B, the fixing mold 12 is sandwiched between and gripped by the hemming roller 40 and the guide roller 42. Upon gripping of the fixing mold 12 in the foregoing manner, locking by the lock mechanism 86 is released (the unlocked state shown in FIG. 5 is brought about). In this manner, since floating of the processing tool 14 is locked when the processing tool 14 is moved close to the workpiece W, vibrations of the processing unit 26 with respect to the base part 24 are suppressed. Consequently, collisions of the processing tool 14 against the fixing mold 12 due to such vibrations do not occur.

As shown in FIG. 7B, the tapered part 66 of the hemming roller 40 presses on the flange-shaped edge portion 22, whereby the edge portion 22 is inclined and bent. Further, the guide roller 42 of the processing tool 14 engages with the guide groove 20 that is provided on the fixing mold 12. In addition, so that the hemming roller 40 moves along the edge portion 22, the processing tool 14 is moved by the robot 16 under the control of the controller 124, whereby a first hemming (pre-hemming) process, by which the edge portion 22 is inclined inwardly over a predetermined range, is carried out.

Figure 8B:
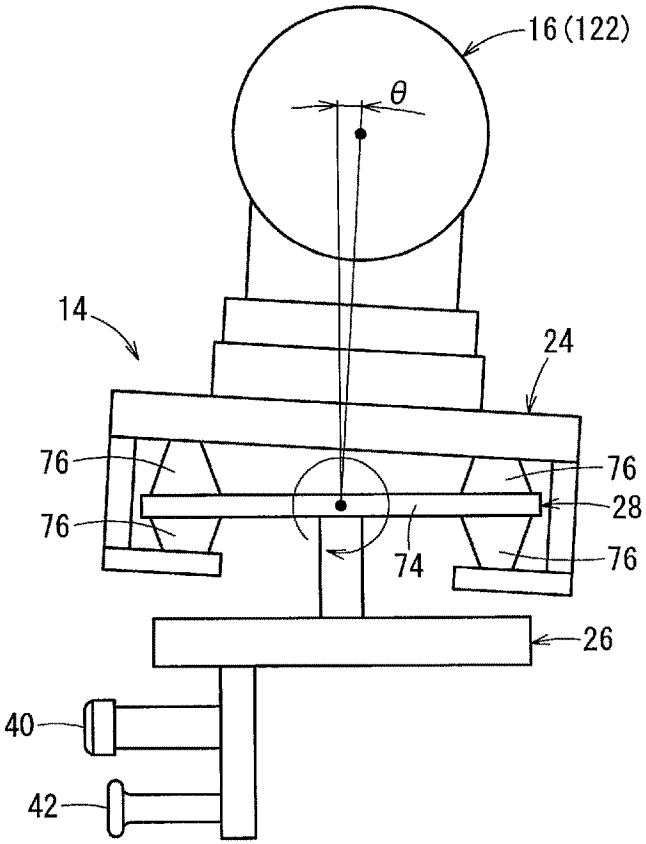
FIG. 8B is a second schematic view for describing actions of the floating mechanism.
Figure 8A:
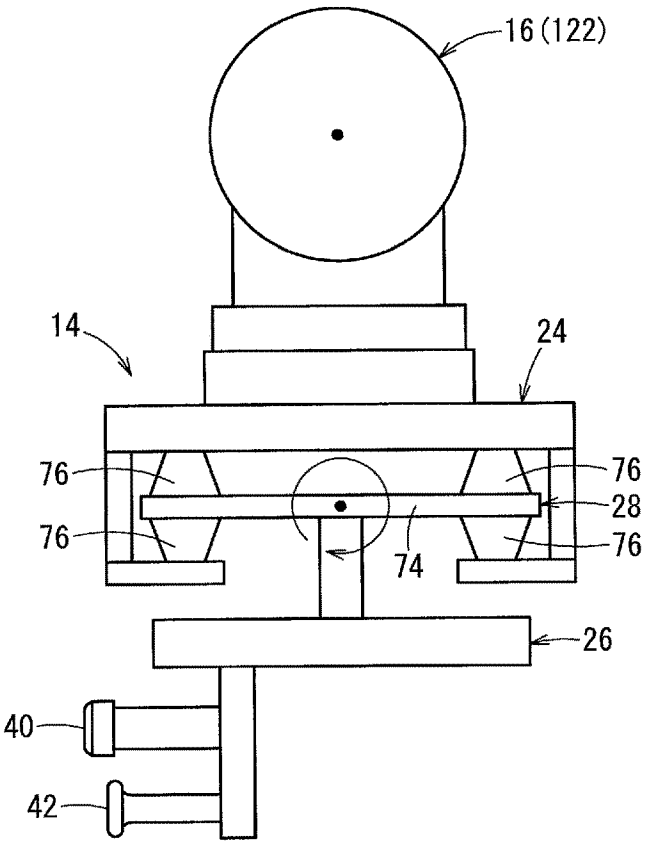
FIG. 8A is a first schematic view for describing actions of a floating mechanism.

FIGS. 8A and 8B are views in which the processing tool 14 is shown schematically. FIG. 8A shows a case in which deviations from the movement trajectory (rotation errors) accompanying rotation in operation of the robot 16 do not occur, when the workpiece W is subjected to processing by the processing tool 14. FIG. 8B shows a case in which rotation errors in operation of the robot 16 take place when the workpiece W is subjected to processing by the processing tool 14.

When the first hemming process is performed, the processing unit 26 is supported elastically by the floating mechanism 28 with six axial degrees of freedom. Therefore, as shown in FIG. 8B, in the event that rotation errors occur in operations of the robot 16, such rotation errors are absorbed by action of the floating mechanism 28. More specifically, by expanding and contracting actions of the elastic members 76 in the floating mechanism 28, the base part 24 connected to the robot 16 rotates with respect to the processing unit 26 by amounts corresponding to the rotation errors, and as a result, the rotation errors are absorbed. Consequently, even if the robot 16 is operated at high speed, rotation errors of the movement trajectory accompanying high speed operations are not transmitted to the hemming roller 40. Thus, along with an enhancement in processing speed, it is possible to improve process quality.

Further, in the present embodiment, when the first hemming process is performed, since the guide roller 42 rolls while in engagement with the guide groove 20, even in the case that the processing tool 14 is moved at high speed by the robot 16, deviation (errors) in the movement trajectory are not transmitted to the hemming roller 40. More specifically, the guide roller 42 moves along an accurate path. Consequently, along with an enhancement in processing speed, it is possible to improve process quality.

Figure 7C:
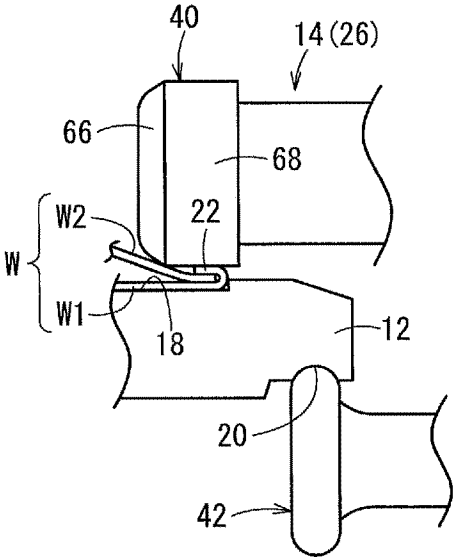
FIG. 7C is a descriptive view of a second hemming process.

Upon completion of the first hemming process, next, the hemming roller 40 is moved in an axial direction with respect to the guide roller 42, and as shown in FIG. 7C, the workpiece W and the fixing mold 12 are gripped by the hemming roller 40 and the guide roller 42. At this time, the cylindrical part 68 of the hemming roller 40 presses the edge portion 22 of the first workpiece W1, whereby the edge portion 22 is folded back 180° in an opposite direction, and the edge portion 22 comes into contact with the edge portion 22 of the second workpiece W2. In addition, so that the hemming roller 40 moves along the edge portion 22, the processing tool 14 is moved by the robot 16 under the control of the controller 124, whereby a second hemming (main hemming) process, by which the edge portion 22 is folded back inwardly over a predetermined range, is carried out.

When the second hemming process is performed, the processing unit 26 is also supported elastically by the floating mechanism 28 with six axial degrees of freedom. Therefore, even if the robot 16 is operated at high speed, rotation errors of the movement trajectory accompanying high speed operations of the robot 16 are not transmitted to the hemming roller 40. Further, also when the second hemming process is performed, the guide roller 42 rolls while in engagement with the guide groove 20. Thus, according to the present embodiment, in the second hemming process as well, along with an enhancement in processing speed, it is possible to improve process quality.

Upon completion of the second hemming process, floating of the processing unit 26 is locked by the lock mechanism 86 (the lock mechanism 86 assumes the condition shown in FIG. 6). Thereafter, the robot 16 is operated, whereby the processing tool 14 separates away from the fixing mold 12. Thereafter, the workpiece W, which has been subjected to the hemming process, is detached (transported out) from the mold.

As described above, in accordance with the processing unit 26 and the hemming process device 10 according to the present embodiment, because the processing unit 26 having the hemming roller 40 and the guide roller 42 is supported by a floating mechanism 28 having six axial degrees of freedom, deviations (rotation errors) in the movement trajectory accompanying rotation of operations of the robot 16 can be absorbed. Consequently, even if the robot 16 is operated at high speed, rotation errors accompanying high speed operations are not transmitted to the hemming roller 40. Thus, along with an enhancement in processing speed, it is possible to improve process quality. Further, the load on the processing tool 14 or the robot 16 caused by such rotation errors can be reduced.

Further, in the present embodiment, the floating mechanism 28 includes the floating plate 74 that supports the processing unit 26, and the elastic members 76 disposed between the base part 24 and the floating plate 74. According to this configuration, the floating mechanism 28 having six axial degrees of freedom can be realized with a simple structure.

Furthermore, in the present embodiment, the first member 30 and the second member 32 are mutually connected by bolts 34 as connecting members that penetrate through the elastic members 76. According to this structure, the bolts 34 function in a dual manner to connect the first member 30 and the second member 32, in addition to supporting the elastic members 76, and therefore, the number of parts can be reduced.

Still further, in the present embodiment, since the lock mechanism 86 is provided, even in the event that the robot 16 is operated at high speed, by means of the locked state of the lock mechanism 86, vibrations of the processing unit 26 with respect to the base part 24 are suppressed. Therefore, during an operation when the processing tool 14 grips the fixing mold 12, collisions of the processing tool 14 against the fixing mold 12 can be prevented.

In the present embodiment, the floating plate 74 is positioned (centering is performed) in a predetermined position (neutral position) when the lock mechanism 86 is in a locked state. Therefore, during an operation when the processing tool 14 grips the fixing mold 12, engagement of the guide roller 42 with respect to the guide groove 20 that is provided on the fixing mold 12 can be carried out without any trouble.

Further, according to the present embodiment, since the first lock members 89 and the second lock members 90 press the floating plate 74 at different locations, the floating plate 74 can be suitably positioned by a small number of the lock members 88, and the structure of the lock mechanism 86 can be simplified.

Furthermore, in the present embodiment, since the first drive units 98 that operate the first lock members 89, and the second drive units 112 that operate the second lock members 90 are disposed on the same side with respect to the floating plate 74, the structure of the lock mechanism 86 can be simplified.

Incidentally, the processing tool 14 shown in FIG. 2 (also referred to below as "the processing tool 14 according to a first exemplary configuration") is attached to the hand unit 122 of the robot 16 at an upper part of the processing tool 14. In other words, the processing tool 14 is of a type in which an upper part of the processing tool 14 is held on the hand unit 122 of the robot 16. Therefore, corner portions of the workpiece W can be processed suitably. Further, when the robot 16 is kept in an elevated position with respect to the workpiece W, the range that the processing tool 14 is capable of reaching is widened.

Figure 9:
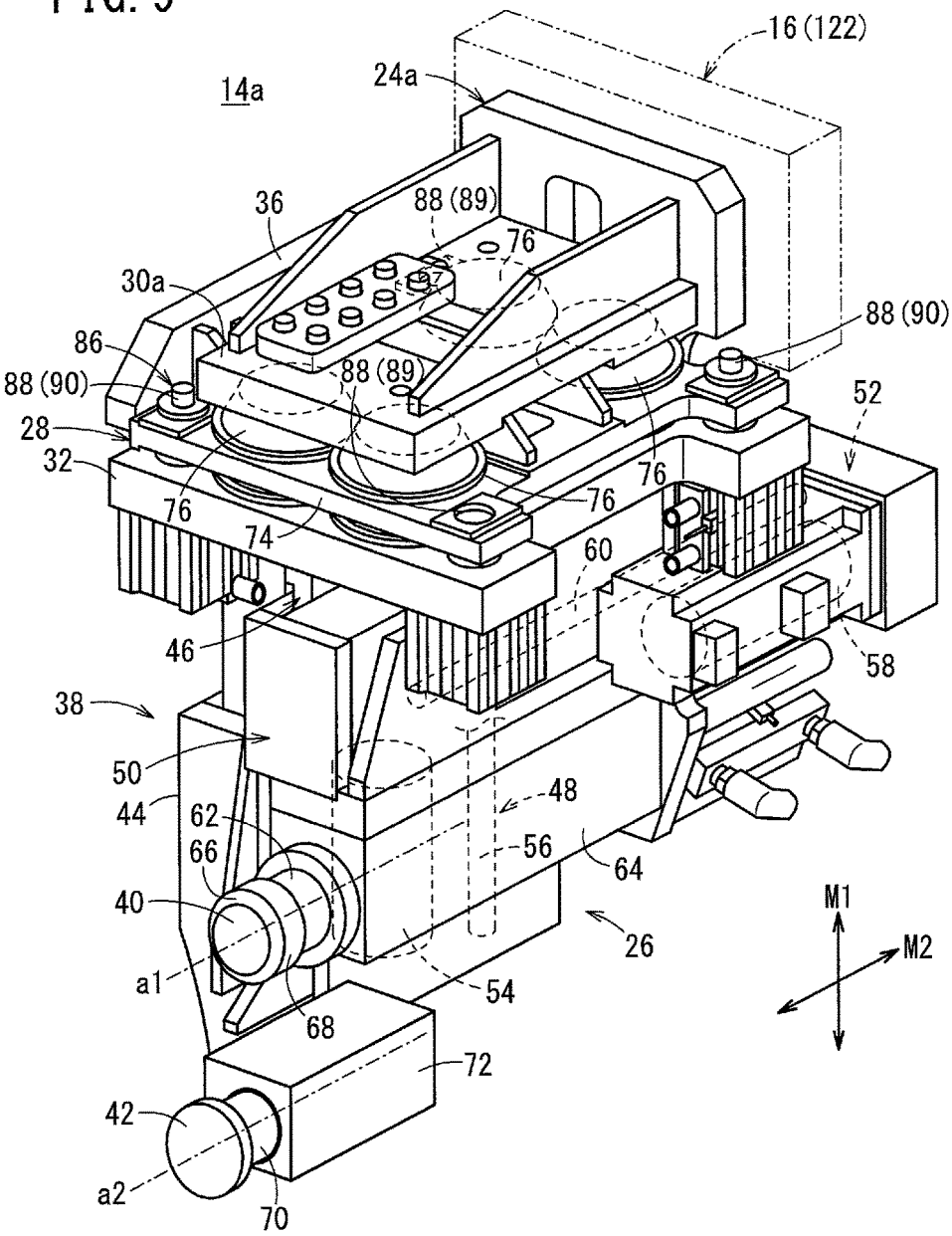
FIG. 9 is a perspective view of a processing tool according to a second exemplary configuration.

FIG. 9 is a perspective view of a processing tool 14*a* according to a second exemplary configuration. The processing tool 14*a* differs from the processing tool 14 shown in FIG. 2 in relation to the structure of a base part 24*a*. More specifically, in the processing tool 14*a*, a first member 30*a* of the base part 24*a* is attached to the hand unit 122 of the robot 16 at a rearward part of the processing tool 14*a*.

Stated otherwise, the processing tool 14*a* is of a type in which the rearward part of the processing tool 14*a* is held on the hand unit 122 of the robot 16. Since the processing tool 14*a* is of a type in which the rearward part thereof is held, the range that the processing tool 14*a* is capable of reaching under operation of the robot 16 can be lengthened. Further, since the upper region of the hemming roller 40 is small, inwardly folded sites can suitably be processed.

Figure 10A:
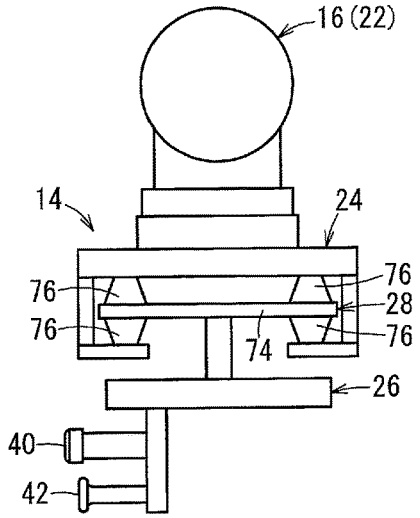
FIG. 10A is a schematic view of a robot (hand unit) and a processing tool according to a first exemplary configuration.
Figure 10B:
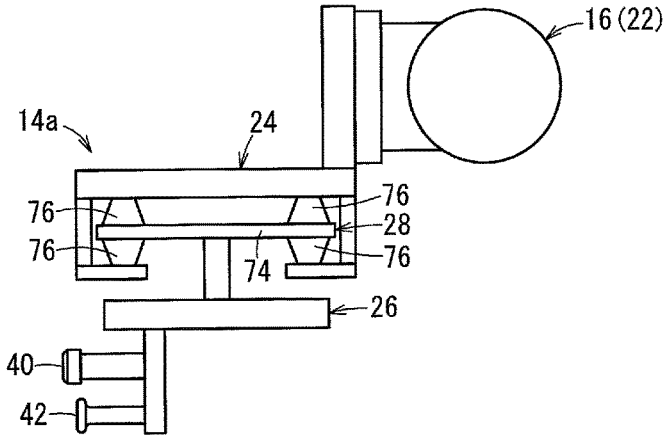
FIG. 10B is a schematic view of a robot (hand unit) and a processing tool according to a second exemplary configuration.

FIG. 10A is a schematic view of the robot 16 (hand unit 122) and the processing tool 14 according to the first exemplary configuration. FIG. 10B is a schematic view of the robot 16 (hand unit 122) and the processing tool 14*a* according to the second exemplary configuration. As shown in FIGS. 10A and 10B, the configurations of the floating mechanism 28 can be the same, in the case that the robot 16 holds from above (FIG. 10A), as well as in the case that the robot 16 holds from the rear (FIG. 10B). More specifically, there is no need to change the layout of the floating mechanism 28 due to the position held by the robot 16.

If multiple processing tools are used with respect to a single workpiece W, then by a combination of the processing tool 14 that is held from above and the processing tool 14*a* that is held from the rear, regions of interference between the robots 16 to which the processing tools are attached can be reduced. More specifically, when the processing tool 14 that is held from above and the processing tool 14*a* that is held from the rear are arranged next to each other, differences in position and posture between the robot 16 to which the processing tool 14 is attached, and the other robot 16 to which the processing tool 14*a* is attached, occur. Due to such differences in position and posture, regions of interference between the robots 16 themselves can be reduced.

Figure 10C:
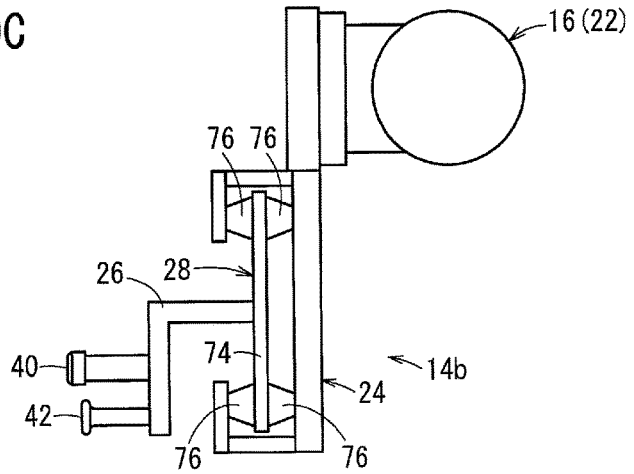
FIG. 10C is a schematic view of a robot (hand unit) and a processing tool according to a third exemplary configuration.

FIG. 10C is a schematic view of the robot 16 (hand unit 122) and a processing tool 14*b* according to a third exemplary configuration. With the processing tool 14*b*, although the holding method of the robot 16 is the same as with the processing tool 14*a* of FIG. 10B, the floating mechanism 28 is arranged vertically and not horizontally. In this manner, even with the same holding method, the posture in which the floating mechanism 28 is arranged can be realized either horizontally (FIG. 10B) or vertically (FIG. 10C).

Although a preferred embodiment of the present invention has been described above, the present invention is not limited to the preferred embodiment. It goes without saying that various modifications can be made to the embodiment without departing from the scope of the invention as defined by the appended claims.

The invention claimed is:

1. A processing tool, which is used by a hemming process device configured to perform a hemming process with respect to an edge portion of a workpiece using a hemming roller and a guide member, comprising:

a base part configured to be moved by a moving mechanism, the base part includes a first member and a second member, which are disposed across from each other;

a processing unit having the hemming roller and the guide member; and a floating mechanism attached to the base part and configured to elastically support the processing unit with six axial degrees of freedom, wherein the floating mechanism includes:

a support member disposed between the first member and the second member to support the processing unit, a first elastic member disposed between the first member and the support member, and a second elastic member disposed between the second member and the support member.

2. The processing tool according to claim 1, wherein the first member and the second member are mutually connected by connecting members that penetrate through the elastic members.

3. The processing tool according to claim 1, further comprising a lock mechanism configured to releasably restrict displacement of the processing unit with respect to the base part.

4. The processing tool according to claim 3, wherein:

the lock mechanism includes a lock member configured to operate between an unlocking position where the lock member is separated from the support member, and a locking position where the lock member contacts with and locks the support member, and the support member is positioned in a predetermined position by displacement of the lock member to the locking position.

5. The processing tool according to claim 4, wherein:

plural lock members are provided; and each of the plural lock members includes:

a first lock member configured to press the support member in a first pressing direction; and a second lock member configured to press the support member in a second pressing direction, which is opposite to the first pressing direction, at a location that differs from a location where the first lock member presses the support member.

6. The processing tool according to claim 5, wherein:

the lock mechanism includes a first drive unit configured to press on and displace the first lock member to the locking position, and a second drive unit configured to pull on and displace the second lock member to the locking position; and the first drive unit and the second drive unit are disposed on a same side with respect to the support member.

7. A hemming process device for performing a hemming process with respect to an edge portion of a workpiece using a hemming roller and a guide member, comprising:

a processing tool; and a robot configured to act as a moving mechanism configured to move the processing tool, wherein the processing tool includes:

a base part configured to be moved by the moving mechanism, the base part includes a first member and a second member, which are disposed across from each other;

a processing unit having the hemming roller and the guide member; and a floating mechanism attached to the base part and configured to elastically support the processing unit with six axial degrees of freedom, wherein the floating mechanism includes:

a support member disposed between the first member and the second member to support the processing unit, a first elastic member disposed between the first member and the support member, and a second elastic member disposed between the second member and the support member.

8. A processing tool, which is used by a hemming process device configured to perform a hemming process with respect to an edge portion of a workpiece using a hemming roller and a guide member, comprising:

a base part configured to be moved by a moving mechanism;

a processing unit having the hemming roller and the guide member;

a floating mechanism attached to the base part and configured to elastically support the processing unit with six axial degrees of freedom; and a lock mechanism configured to releasably restrict displacement of the processing unit with respect to the base part, wherein:

the floating mechanism includes a support member configured to support the processing unit, and an elastic member disposed between the base part and the support member;

the lock mechanism includes a lock member configured to operate between an unlocking position where the lock member is separated from the support member, and a locking position where the lock member contacts with and locks the support member, and the support member is positioned in a predetermined position by displacement of the lock member to the locking position.

* * * * *